US009918901B2

(12) United States Patent
Perovitch

(10) Patent No.: US 9,918,901 B2
(45) Date of Patent: Mar. 20, 2018

(54) DEVICE FOR PACKAGING, STORING, AND EXTEMPORANEOUSLY PREPARING A PLURALITY OF ACTIVE PRINCIPLES

(71) Applicant: Philippe Perovitch, Le Temple (FR)

(72) Inventor: Philippe Perovitch, Le Temple (FR)

( * ) Notice: Subject to any disclaimer, the term of this patent is extended or adjusted under 35 U.S.C. 154(b) by 26 days.

(21) Appl. No.: 15/098,959

(22) Filed: Apr. 14, 2016

(65) Prior Publication Data

US 2016/0220446 A1 Aug. 4, 2016

Related U.S. Application Data

(62) Division of application No. 13/990,228, filed as application No. PCT/FR2011/052795 on Nov. 28, 2011, now Pat. No. 9,394,090.

(30) Foreign Application Priority Data

Nov. 30, 2010 (FR) ..... 10 59883

(51) Int. Cl.
*B65D 25/08* (2006.01)
*A61J 1/20* (2006.01)
(Continued)

(52) U.S. Cl.
CPC ..... *A61J 1/2006* (2015.05); *A61J 1/035* (2013.01); *A61J 1/2079* (2015.05); *A61J 1/2093* (2013.01);
(Continued)

(58) Field of Classification Search
CPC ..... B65D 81/3211; B65D 81/3222; B65D 51/2835; B65D 47/38; B65D 51/2821;
(Continued)

(56) References Cited

U.S. PATENT DOCUMENTS 4,638,927 A 1/1987 Morane
4,648,532 A * 3/1987 Green ..... A61C 5/64 206/222
(Continued)

FOREIGN PATENT DOCUMENTS

EP 1 023 229 B1 5/2004
FR 2 564 433 A1 11/1985
(Continued)

OTHER PUBLICATIONS

International Search Report of PCT/FR2011/052795, dated Mar. 29, 2012.

*Primary Examiner* — J. Gregory Pickett
*Assistant Examiner* — Rafael Ortiz
(74) *Attorney, Agent, or Firm* — Sughrue Mion, PLLC

(57) ABSTRACT

A device for packaging, conserving, and extemporaneously preparing a plurality of active principles, including a reservoir having a compartment for containing a volume of liquid, the reservoir including a neck defining a dispenser opening; a head that is movable relative to the reservoir between a first distal position for conservation and a second proximate position for preparation; a leaktight closure mechanism; and a rupture mechanism for rupturing the closure mechanism. The closure mechanism is formed by a blister that contains at least two active principles and has at least two compartments, each compartment containing an active principle. The blister is fastened on the neck of the reservoir so as to close it, such that after opening the blister by the rupture mechanism, the active principles enter into contact with the liquid and dissolve therein.

16 Claims, 3 Drawing Sheets

(51) Int. Cl.

| | |
|---|---|
| ***A61J 1/03*** | (2006.01) |
| ***B65D 51/28*** | (2006.01) |
| ***B65D 47/38*** | (2006.01) |
| *A61J 1/06* | (2006.01) |

(52) U.S. Cl.
CPC ..... *B65D 47/38* (2013.01); *B65D 51/2821* (2013.01); *A61J 1/065* (2013.01); *A61J 1/201* (2015.05); *A61J 1/2027* (2015.05); *A61J 1/2086* (2015.05)

(58) Field of Classification Search
CPC ..... B65D 25/08; A61J 1/2006; A61J 1/2079; A61J 1/035; A61J 1/2093
USPC ..... 206/219, 222, 220; 222/80; 220/203.08; 604/411, 410, 416
See application file for complete search history.

(56) References Cited

U.S. PATENT DOCUMENTS

| | | | | |
|---|---|---|---|---|
| 5,794,802 | A * | 8/1998 | Caola | A61J 1/2093 206/219 |
| 6,098,795 | A * | 8/2000 | Mollstam | A23C 9/1234 206/219 |
| 6,644,471 | B1 | 11/2003 | Anderson | |
| 8,297,456 | B1 | 10/2012 | Anderson | |
| 8,485,359 | B2 | 7/2013 | Anderson | |
| 2002/0030056 | A1 | 3/2002 | Hsu | |
| 2006/0254935 | A1 | 11/2006 | Pearce et al. | |
| 2008/0023349 | A1 * | 1/2008 | Balazik | B65D 51/28 206/222 |
| 2010/0198147 | A1 * | 8/2010 | Perovitch | A61J 1/067 604/77 |
| 2011/0054437 | A1 | 3/2011 | Perovitch et al. | |
| 2011/0278185 | A1 | 11/2011 | Aguadisch et al. | |

FOREIGN PATENT DOCUMENTS

| | | | | |
|---|---|---|---|---|
| WO | 99/61339 | A1 | 12/1999 | |
| WO | 2008/002160 | A2 | 1/2008 | |
| WO | 2009/016309 | A2 | 2/2009 | |
| WO | WO 2009016309 | A2 * | 2/2009 | A61J 1/067 |
| WO | 2009/138644 | A1 | 11/2009 | |
| WO | 2011/006589 | A2 | 1/2011 | |

* cited by examiner

DEVICE FOR PACKAGING, STORING, AND EXTEMPORANEOUSLY PREPARING A PLURALITY OF ACTIVE PRINCIPLES

This application is a division of application Ser. No. 13/990,228 filed May 29, 2013, which is a National Stage of International Application No. PCT/FR2011/052795 filed Nov. 28, 2011, claiming priority based on French Patent Application No. 10 59883, filed Nov. 30, 2010, the contents of all of which are incorporated herein by reference in their entirety.

The present invention relates to devices for packaging, conserving, and extemporaneously preparing a plurality of active principles, in particular in very small doses and in particular active principles that are fragile, labile, or unstable, with a view more particularly to administering them locally or systemically, intravenously, intramuscularly, subcutaneously, or via the oral mucous membrane.

Document WO 2009/138644 describes a device that makes it possible to mix an active principle with a solvent, the active principle being conserved in hermetic and sterile conditions in the space inside a movable head of said device, the movable head being provided with rupture means for rupturing a leaktight membrane that closes an underlying leaktight reservoir compartment containing a liquid that dissolves the active principle in question, which solvent is also sterile. The rupture means of the movable head breaking the membrane enables the active principle deposited in said movable head to be dissolved instantaneously and extemporaneously when the active principle comes into contact with the liquid for dissolving it. Without any exteriorization of the contents, and while in an atmosphere that continues to be leaktight and sterile, that device makes it possible to put the active principle into contact with the solvent, so as to obtain instantaneous dissolution of the active principle. More particularly, the device enables very small doses of active principle to be dissolved extemporaneously in sterile conditions, which doses are typically of less than 1 milligram (mg) to a few tens of milligrams only, i.e. doses that are tiny and cannot be manipulated in the hand without losing or spoiling or even contaminating their dry or liquid elements.

Document WO 2009/016309 similarly describes means for dissolving an active principle for administering via the oral mucous membrane in a hydro-alcoholic solution having a high degree of ethanol, which solution is contained in a leaktight reservoir that is sealed by a perforatable membrane. Such dissolution is obtained after extemporaneous mixing of the active principle and solvent inside said device. The device also enables a small volume of solution (typically less than 5 milliliters (mL)) to be administered therapeutically by accurately depositing it in contact with a zone of the oral mucous membrane by means of a cannula forming the top portion of said device.

Unfortunately, while the active principle is being packaged in those devices, specifically the devices of documents WO 2009/138644 and WO 2009/016309, it is merely deposited in chambers that make up each of the two devices, the walls of the movable head, and also the floor constituted by the perforatable membrane that can support said active principle while also closing the solvent reservoir in leaktight manner. However, it is found that a certain number of conditions for optimizing the protection of the active principle are not achieved in completely satisfactory manner in either of those two devices, since the active principle remains in intimate contact with the materials constituting those chambers and supports, which materials generally do not provide the best conditions and qualities currently required for conserving pharmaceutical active principles. Even when deposited in the form of an orally disintegrating tablet (ODT) in contact with an inert closure membrane, for example, there may be a loss of quality of the active principle merely by contact between the active principle and the surrounding air and/or between the active principle and the internal polymeric wall of the container. Thus, the best conditions for stability of the active principle are not guaranteed, since certain components, in particular polymeric components, may migrate from the walls of the container to the often-labile pharmaceutical active principle that is deposited therein. That is why Health Authorities always require long verification studies to be performed, checking on potential exchange, degradation, and pollution, resulting from residual migration from the wall of the container to the active principle, or from the active principle spoiling merely on coming into contact therewith. Documents FR 2 564 433, EP 1 023 229, US 2002/030056, and U.S. Pat. No. 6,644,471 describe other prior-art devices.

An object of the present invention is to overcome the above-mentioned drawbacks of existing devices, and in particular those of documents WO 2009/138644 and WO 2009/016309, by making them easier to manufacture and making it easier to package substances therein, while providing them with additional capabilities, in particular making it easier to produce complex preparations having multiple components and/or solvents.

In particular, an object of the present invention is to improve such devices, by simplifying them and the techniques and the costs of manufacturing them, in order to better guarantee the protection, the conservation, and the long term intrinsic quality of a plurality of active principles inserted into those devices, which active principles are often extremely fragile and very costly (sometimes several thousands of euros per dose), and where "long term" means for a shelf life of at least three years.

Another object of the present invention is to propose a simple technical solution that, without making the manufacture of the devices under consideration more complex or more costly, makes it possible to prevent any risk of the active principles chemically degrading and/or being contaminated over time, e.g. in the context of a possible content/container interaction, and thus avoid the requirements of regulation to perform studies and verifications.

In particular, the present invention proposes ensuring that the separator membrane situated between a dry compartment and a liquid compartment has two capabilities: while continuing to be a perforatable intercompartmental sealing membrane, it now presents the capacity to contain multiple active principles, both grouped together therein and also completely separate from one another.

The present invention thus provides a device for packaging, conserving, and extemporaneously preparing a plurality of active principles, said device comprising: a reservoir having at least one compartment for containing at least one volume of liquid, said reservoir including a neck that defines a dispenser opening of the reservoir; a head that is movable relative to said reservoir between a first position for conservation, in which said head is in its distal position relative to the reservoir, and a second position for preparation, in which said head is in its proximal position relative to the reservoir; leaktight closure means for closing the neck of said reservoir; and rupture means for rupturing said leaktight closure means; said leaktight closure means being formed by a leaktight blister that contains at least two active principles, said blister having at least two compartments that are separated by longitudinal and/or transverse and/or superposed partitions, each compartment containing an active principle, said blister being fastened on the neck of said reservoir so as to close it in leaktight manner, such that after opening said blister by said rupture means, said active principles enter into contact with the liquid and dissolve therein.

Advantageously, at least one active principle is in solid form.

Advantageously, at least one active principle is in the form of a powder, an ODT, a lyophilisate, a tablet, or a gel.

In a variant, at least one active principle is in liquid form.

Advantageously, said blister includes an outer wall that faces towards the outside of the reservoir, and an inner wall that faces towards the inside of the reservoir.

Advantageously, said blister includes a radially-outer peripheral flange that is fastened on a radial edge of said reservoir.

Advantageously, said fastening is achieved by heat-sealing or high-frequency polymerization methods, or by leaktight crimping by mechanical stress with flexible gaskets under a formed or heat-shrink or crimped ring.

Advantageously, said blister is manufactured beforehand, filled with said active principles and sealed, before being fastened in leaktight manner on said reservoir.

Advantageously, a sealing gasket is interposed between the head and the reservoir so as to guarantee sealing after the blister has been opened by the rupture means.

Advantageously, said liquid contained in the reservoir is a solvent or a hydro-alcoholic solution.

Advantageously, the volume of said liquid contained in the reservoir is less than 5 mL.

Advantageously, said reservoir includes a filling opening that is remote from said neck of the reservoir, said filling opening being sealed in leaktight manner by a stopper after filling said reservoir with said liquid, said stopper advantageously being secured to a grip tab.

In an advantageous first embodiment, said head includes a filter and a dose-taking membrane, an internal component, preferably in the shape of a hollow cylinder, being inserted into said head so as to define said dose-taking chamber in the volume defined in said internal component between said filter and said dose-taking membrane.

Advantageously, the dimensions of said internal component can be varied, so as to define dose-taking chambers of shapes and volumes that vary.

In an advantageous second embodiment, said movable head includes a cannula having a dispenser orifice that is closed by an end stopper that contains solid or liquid active principles that are held in said end stopper by a separator membrane, said active principles being released into said cannula by rupturing said separator membrane, advantageously by tightening said end stopper fully onto said dispenser orifice of said cannula.

In a variant, said movable head includes a cannula having a dispenser orifice that is closed by an end stopper that contains at least one solid or liquid active principle that is held in said end stopper by a separator membrane, said cannula also containing at least one solid or liquid active principle, said active principles being mixed in said cannula by rupturing said separator membrane, advantageously by tightening said end stopper fully onto said dispenser orifice of said cannula.

These characteristics and advantages and others of the present invention appear more clearly from the following detailed description, given by way of non-limiting example, and with reference to the accompanying drawings, and in which.

In order to make the drawings clear, the proportions are not necessarily to scale.

Figure 1:
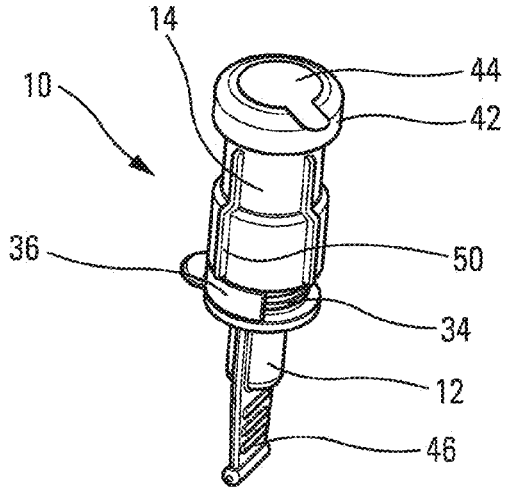
FIG. 1 is a perspective view of the device in a first advantageous embodiment of the invention.
Figure 2:
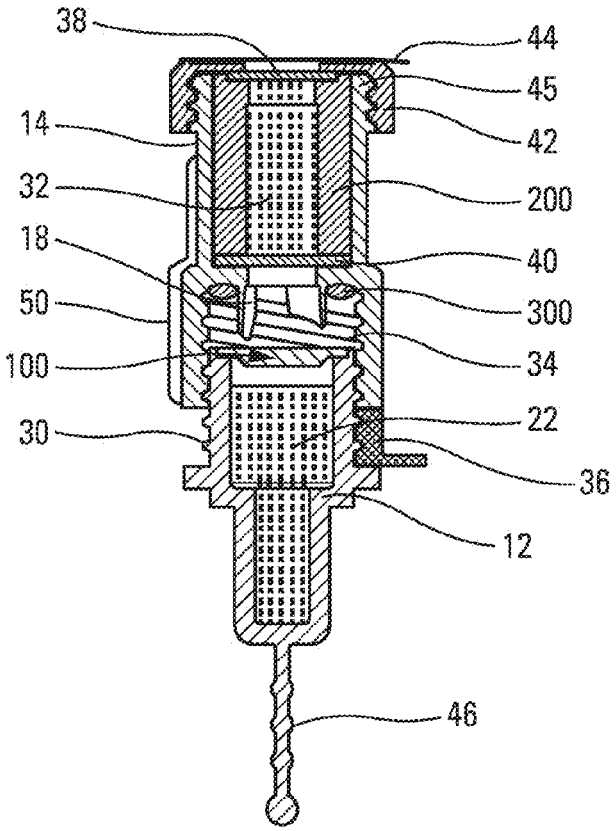
FIG. 2 is a diagrammatic section view of the FIG. 1 device, before use.

With reference to FIGS. 1 and 2, an advantageous embodiment of the invention is described below, based on the device of document WO 2009/138644. Naturally, the present invention also applies to other types of device, and in particular devices of the type described in document WO 2009/016309 that is described in greater detail with reference to FIG. 8.

The example of FIGS. 1 and 2 shows a device 10 including a reservoir 12 that may be made out of any material that avoids evaporation through the wall, and that is suitable for preventing light or air from acting on its contents. Preferably, the material constituting the reservoir 12 does not leach out undesirable constituent substances on contact with the solvent that it contains, in particular an aqueous solvent. The reservoir includes a neck that defines a dispenser opening through which the contents of said reservoir can be dispensed.

Such a reservoir is advantageously a single piece made out of thick plastics material or out of glass, that is preferably made opaque, of pharmaceutical quality, very strong, and of any section, e.g. square, oval, rectangular, triangular, or round.

The device 10 includes a head 14 that is secured to the reservoir 12 so as to be movable relative thereto, at least in translation.

The head 14 is movable between a first position for conservation, in which said head 14 is in its distal position relative to the reservoir 12, and a second position for preparation, in which said head 14 is in its proximal position relative to the reservoir 12.

The reservoir 12 includes at least one compartment for containing a very small volume of at least one pharmaceutical solvent 22, such as physiological serum for application in injectable form, or a hydro-alcoholic solution so as to make it possible to administer dissolved active principles on coming into contact with the oral mucous membrane.

Preferably, the volume of solvent in a compartment is a volume that is less than 5 mL, very preferably less than 1 mL.

The neck of the reservoir 12 is closed in leaktight manner. In an aspect of the invention, the neck of the reservoir is closed in leaktight manner by a membrane in the form of a blister having an internal volume for receiving substances, referred to below as a blister 100, comprising at least two compartments, each for containing a dose of at least one active principle in solid form, e.g. in the form of a lyophilisate, a powder, a tablet, or a specific polymeric gel, or in liquid form. In preferred manner, the active principle is in powder or lyophilized form.

The dose of active principle in such a blister is preferably a dose that is less than 50 mg, preferably less than 10 mg, or even less than 5 mg.

The device of the invention is adapted to doses that vary depending on the type of active principles under consideration, their specific routes of administration, and the number of different components and compartments in the device. In particular, it is adapted to administering very small doses of active principles, but may be used for larger doses.

The term "active principle" means a substance or a combination of substances capable of producing demonstrable pharmacological activity on extra- or intra-cellular collections of tissues or of receptors, so as to reduce, prevent, or correct an acute or chronic or epidemic affection or a particular degeneration.

Figure 3:
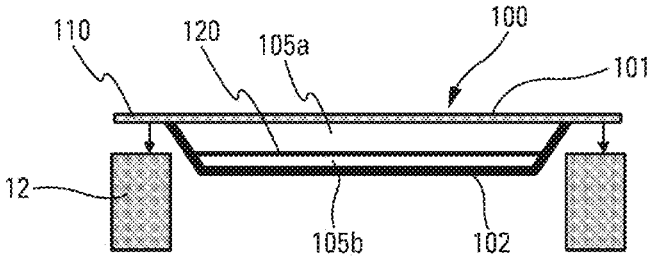
FIGS. 3 and 4 are diagrammatic views of two variants of the invention.
Figure 4:
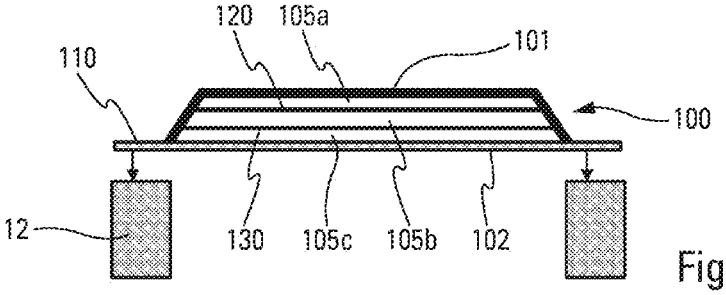
Figure 5:
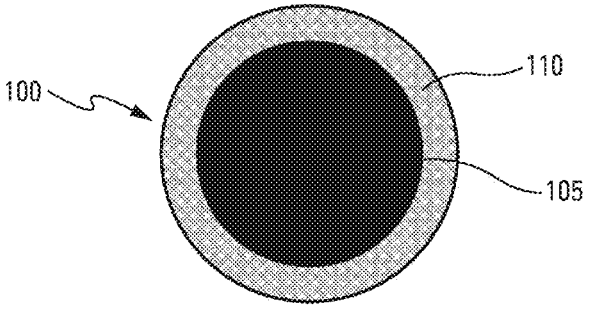
FIGS. 5 to 7 are diagrammatic plan views of three other variants of the invention.

The blister 100 includes a radially-outer peripheral flange 110 that is adapted to be fastened in leaktight manner on the edge of the neck of the reservoir 12. If the reservoir 12 is filled via said neck, the blister 100 is fastened after filling. In a variant, if the reservoir 12 is filled via another filling passage, e.g. via a filling opening provided in the reservoir and placed in any section of said reservoir, e.g. its base portion, filling may advantageously take place after the blister 100 has previously been fastened on the neck of the reservoir. By way of example, in order to close the neck of the reservoir 12, said blister 100 may be fastened by heat-sealing or high-frequency polymerization methods, or by any other methods that are usual in such applications, or by using other compatible and adapted techniques, such as sealing by mechanical stress (formed or heat-shrink or crimped ring). FIGS. 3 and 4 show two variants for fastening the blister 100 on the reservoir 12, with the blister cavity oriented respectively towards the inside (FIG. 3) or towards the outside (FIG. 4) of the reservoir 12, after fastening. FIG. 2 shows the same variant as FIG. 3, but naturally it is only a non-limiting embodiment. The blister 100 comprises an outer wall 101 and an inner wall 102. The outer wall 101 thus faces towards the outside of the reservoir 12, and the inner wall 102 faces towards the inside of the reservoir 12. The outer and inner walls 101, 102 are preferably parallel to each other and substantially perpendicular to the longitudinal central axis of the reservoir 12.

Figure 6:
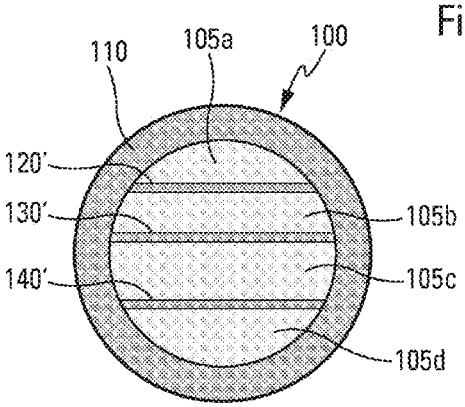
Figure 7:
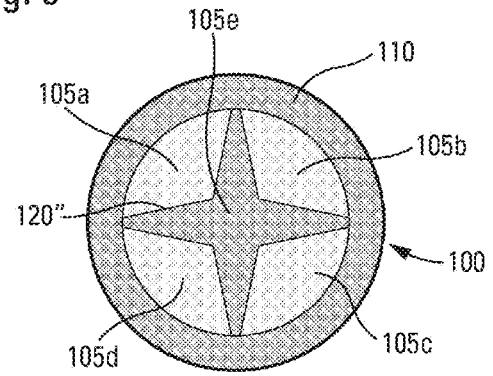

The structure of the blister can vary, e.g. depending on the number of compartments that are desired. FIG. 3 shows a blister with two compartments 105*a* and 105*b* that are separated by a longitudinal partition 120, i.e. a partition that extends in the width direction, parallel to the top and bottom walls 101 and 102 of the blister 100. FIG. 4 includes three compartments 105*a*, 105*b*, and 105*c* that are separated by two longitudinal partitions 120 and 130. FIG. 6 shows four compartments 105*a*, 105*b*, 105*c*, and 105*d* that are separated by three transverse partitions 120', 130', and 140', i.e. partitions that extend in the height direction, perpendicularly to the top and bottom walls 101 and 102 of the blister 100. FIG. 7 shows a complex structure with a partition 120" that is star shaped in plan view, that defines five compartments, four compartments 105*a*, 105*b*, 105*c*, and 105*d* on the outside of the partition 120", and one compartment 105*e* on the inside of the partition 120". Naturally, it is possible to envisage any number of compartments and any desirable shapes for partitions, and the examples shown are thus non-limiting.

With the blister of the invention, a plurality of active principles may thus be grouped together without difficulty in this space which is both a shutter and a perforatable leaktight container, and in such a manner so as to allow extemporaneous internal dissolution to take place.

With the perforatable shutter blister situated inside the device for extemporaneous preparation, said active principles are concentrated in the best contact location for being dissolved, and they are simultaneously protected from any degradation or spoiling that may result from the walls of the devices or mutually between various components, since they are conserved strictly separate from one another in said blister, possibly in compartmentalized or stratified manner. In this way, in view of the leaktight capability associated with the quality of the shutter blister, an effective barrier separates the active principles from any possible chemical contamination due to residues of the chemical structures that constitute the materials of the devices, with this separation being continuous until the active principles are dissolved.

The active principle(s) may thus be deposited within said blister in any known form (a powder, an ODT, a granule, a grain, a gel, a semi-solid, etc. . . . ).

By way of example, very small-dose powders may be deposited very accurately and without loss in such blisters by robotic systems designed for this purpose.

It should be observed that said blister could even include a compartment for liquid in its available internal spaces. For a shutter blister having dry and liquid compartments, the blister may be packaged/filled in two successive steps, e.g. firstly the dry compartment, (a powder, an ODT, . . . ), that is filled and sealed in a first operation, then the liquid compartment, that is filled and sealed in a second step.

In the embodiment in FIGS. 1 and 2, in its top portion, the head 14 includes at least one dose-taking chamber 32 that is provided with a filter or filter membrane 40 that makes it possible to avoid any particulate contamination of the dissolved active principle while taking the dose, by mechanically filtering the solution before taking it. If necessary, the device may also include a plurality of dose-taking chambers.

The dose-taking chamber 32 is preferably of appropriate size. Advantageously, its length is greater than or equal to the length of a dose-taking needle, i.e. typically in the range about 8 mm to 40 mm, such that at the end of its stroke, a needle can never damage the filter 40, and also such that the end of the inserted dose-taking needle remains situated within the liquid to be taken.

The filter 40 preferably presents a mesh lying in the range 5 micrometers (μm) to 500 μm.

The device 10 in FIGS. 1 and 2 also includes rupture means 18 for rupturing the blister 100 so that the active principles enter into contact with the solvent 22 and dissolve therein.

In a preferred embodiment, the rupture means 18 are cutter means for cutting the walls 101 and 102 of the blister 100, e.g. perforator means.

The reservoir 12 and the head 14 are fitted with displacement means 30, 34, making it possible to move said head 14 in translation, from its distal position to its proximal position. In the preferred embodiment, and by way of example, the means for imparting movement in translation comprise a screw thread assembly 30 or a bayonet device enabling maintained rotation, preferably passing through a total of one fourth of a turn only, and that is carried by the reservoir 12, more particularly by the neck of the reservoir, and tapping 34 of profile complementary to the screw thread of the container carried by the head 14 in such a manner as to co-operate by screw-engagement.

The container is also provided with safety-locking means so as to prevent any involuntary movement in translation of the head 14 relative to the reservoir 12. The locking means advantageously comprise a removable ring 36 that is interposed between the head 14 in its distal position and the reservoir 12. The ring 36 may have a C-shaped profile or may be a tearable continuous circular band that comes to be mounted in resilient manner on the screw thread 30 that is carried by the reservoir 12, thereby preventing the head 14 from moving in translation relative to the reservoir 12.

In another aspect, the head 14 is provided with a membrane 38 that is flexible, leaktight, protective, and perforatable for enabling the dose to be taken. The dose-taking membrane 38 is for perforating in order to take the contents of the device 10 by means of a sterile syringe and needle. Preferably, the dose-taking membrane 38, that may be made of polymer or sterile medical latex rubber, is fastened on the head and protected by a protective cap 42 that is held on the head 14 via a fastening 45 by screw-fastening or clipping or crimping. The cap 42 may include a central axial opening that is closed by a removable safety tab 44 that protects the sterility of said dose-taking membrane 38.

When the practitioner wishes to administer the medication, it suffices for the practitioner to remove the ring 36 merely be pulling it off, and then to screw the head 14 on tighter. Said head thus moves in translation, thereby causing the rupture means 18 to open the walls 101 and 102 of the blister that provided leaktight closure of the reservoir 12 and separation between the solvent 22 and the active principles, thereby enabling the active principles to dissolve in the solvent. For better dissolution, it is preferable to shake the solution for a few seconds. Removing the safety tab 44 makes it possible to access the dose-taking membrane 38 through the central axial opening of the cap 42. In a variant, the cap 42 may be also be removable from the head 14, e.g. unscrewable. The user needs only to perforate the dose-taking membrane 38 by means of a sterile mini syringe and needle in order to take the contents of the device. Since the device is held vertically with the dose-taking membrane 38 towards the bottom, the user can thus inject, through the membrane 38, a volume of air that it preferably greater than at least twice the volume of medicated solution that the user wishes to take, so as to create positive internal air pressure in the top portion of the device while the liquid is being extracted, and thus so as to make it easier for the therapeutic solution to pass through the filter 40. By suction into the dose-taking syringe, the user recovers the desired volume of the solution contained in the device 10 and deposits said volume in the intended location, e.g. in the front chamber of the eye for preventing post-phacocystectomy infections.

The sterile needle carried by an appropriate syringe makes it possible to administer the prepared solution immediately, whatever the route of administration: intra-ophthalmic, intravenous, intramuscular, subcutaneous, intra-articular, intra-cavity.

Thus, the active principle is dissolved in the solvent just before it is administered, thereby preventing any premature degradation.

A required dose of active principle is administered in accurate and controlled manner.

As described above, the dimensions of the device have been maximized so as to make it possible to show the structural details as well as possible, but account should be taken of the fact that the dimensions of a container may lie in the range 0.01 mL to 5 mL, the device being extremely small and difficult to manipulate.

A grip tab 46, advantageously arranged at the bottom portion of the reservoir 12, may also be provided. The grip tab 46 makes a good two-digit pinch grip possible in spite of the small size of the container, so as to enable the user to turn the head 14. The tab 46 may also form an extension of a leaktight closure stopper of a filling opening that could be provided in the base of the reservoir 12. The tab 46 also provides a manipulation advantage after the head has been turned relative to the reservoir and after the safety tab 44 has been removed, namely the advantage of enabling the contents to be taken easily by means of an appropriate device.

Furthermore, on its peripheral outer surface, the head 14 may include easy-grip means 50, such as bearing fins.

The advantages associated with the use of a shutter blister are numerous:

- during perforation of said blister, the active principles are dissolved extemporaneously and simultaneously on encountering the liquid solution delivered by said rupture; as a result, they are put together in ideal manner for dissolving them as well as possible in a single step, since they are put into contact with the liquid pressed out during the rupture of the blister assembly at this point;
- the blister, when compartmentalized, presents the advantage of being able to contain a plurality of active principles that would never be compatible with one another over time if they had to remain in contact with one another, and especially the advantage of protecting them in completely leaktight and separate manner;
- in the most appropriate manner, the invention satisfies the recommendations of the Health Authorities, seeking to prevent prolonged exchanges and migrations by contact between active principle(s) and the walls of the container; by means of the invention, since the therapeutic solution is formed only at the moment of its medical use, it does not come into contact with the wall materials of the container for more than a few seconds before being removed therefrom for administration, i.e. for a period of time that does not have any consequences that can actually be measured;
- from a pharmaceutical point of view, the blister guarantees optimum protection of the active principles under consideration, since because such composite structures have been in very extensive use for decades, e.g. structures of metalloplastic type, the means used are extremely widespread in the pharmaceutical and associated industries, and constitute means that have been evaluated for a long time and found to be perfectly adapted to most pharmaceutical active principles and to their specific peculiarities, thereby enabling them to be conserved better over time, with this applying under various formulations;
- the invention simplifies the method of manufacture considerably, since it makes it possible to use the same means to perform two operations, namely closing the solvent reservoir and simultaneously grouping together and protecting the active principles in the best conditions of stability required over several years, while placing them in the best possible position for putting them into solution, namely in proximal contact with the solvent liquid;
- the invention also makes it possible, in extremely advantageous and low-cost manner compared to prior techniques, to implement distinct manufacturing programs over time, namely packaging the leaktight shutter blister containing the active principles, filling the solvent reservoir, and closing the reservoir using that said blister, without any constraint of simultaneity for operations that are all equally demanding, and always performed in sterile conditions and atmosphere.

The invention thus considerably simplifies packaging the active principles under consideration, especially for very small doses, and guarantees that their pharmaceutical quality is maintained over time.

Such very small blisters, including one or more separate compartments or one or more superposed filling layers, each receiving small doses of active principles, may be manufactured and filled by conventional, automatic, filling and sealing machines for pharmaceutical packaging of microdoses, e.g. of the "XCELODOSE" type proposed by Capsugel Inc., or by microdose appliances with unitary dispensing of the Quantos Dosing type by Mettler Toledo.

In another aspect, the device in FIGS. 1 and 2, adapted to extemporaneous preparation of injectable sterile solutions, includes an internal component 200 that may be placed in contact with the walls of the dose-taking chamber 32, which, as a result, is modified in size, and particularly in section, in height, and in volume. The internal component 200, preferably made in the shape of a hollow cylinder, may be inserted into said dose-taking chamber 32 so as to provide several functions:

1/ holding the filter or filter membrane 40 of the movable head 14, e.g. by jamming said filter between the bottom edge of the cylinder (in the position in FIG. 2) and an appropriate inner shoulder of the movable head 14;

2/ holding the protective membrane 38 of the movable head 14, e.g. by jamming said membrane between the top edge of the cylinder (in the position in FIG. 2) and the protective cap 42; as a result of the stress exerted, this also makes it possible to provide better sealing of the head at the protective membrane 38;

3/ simplifying the assembly of the filter 40 and of the protective membrane 38;

4/ making it possible to use the internal volume of said cylinder for containing an additional active principle that can be deposited therein in any appropriate form; it should be understood that the body of said cylinder 200 may be made of a material that is completely inert and consequently that does not have any chemical residue, e.g. glass or metal, such that the active principle that is deposited therein and that is in contact therewith is not spoiled; and 5/ creating a dose-taking chamber 32 of volume and of height that can be varied, with volume being defined by the available internal cavity of said cylinder, with a capacity that is determined specifically for each application for particular active principles; with this variable cylinder, the invention makes it possible to obtain a liquid column inside said dose-taking chamber in such a manner that, being established over an appropriate height, said liquid column always remains sufficiently narrow in width or in section for the end of the suction needle that is inserted through the perforatable sterile membrane 38 to remain in the presence of a sufficient quantity of liquid to be sucked up, such that during conventional dose-taking in the vertical position, the dose-taking needle remains more constantly in contact with the solution that it is taking, without sucking in air.

It should be observed that the use of this cylinder is advantageously combined with the use of the above-described blister, but the cylinder could also be used independently of said blister. In particular, such a cylinder may be used very advantageously in a device as described in document WO 2009/138644.

It should be observed that the use of the blister 100 is described above with reference to FIGS. 1 and 2 for a device of the type described in document WO 2009/138644. Naturally, the blister could also be used on other types of device, e.g. of the type described in document WO 2009/016309, as shown diagrammatically in FIG. 8. This second embodiment describes a device for administration via the oral mucous membrane of active principles that have been put into hydro-alcoholic solution. Similar component elements have the same numerical references. The device 10 includes a reservoir 12, typically made of plastics material or of glass, containing a small volume of a hydro-alcoholic solution 23. The reservoir is closed in leaktight manner by a blister structure 100 containing a plurality of active principles. The structure and the function of the blister 100 may be identical or similar to the structure and function of the blisters described above with reference to the first embodiment, and shown in FIGS. 3 to 7. This blister provides an exclusive service by making it possible to mix labile active principles extemporaneously with a hydro-alcoholic solution, so as to enable immediate systemic therapeutic administration via the oral mucous membrane. By way of example, the neck of the reservoir 12 may include a screw thread 30 on which there may be screw-fastened tapping 34 in a movable head 14. A safety strip 36 is advantageously provided so as to prevent any undesired movement of the head 14 relative to the reservoir 12. The movable head 14 includes a cannula 141 that defines a tube with an air inlet 142. The dispenser orifice of the cannula 141 may be closed by an end stopper 143. The end stopper 143 may also contain at least two active principles, whether they be in solid or liquid form, retained in said end stopper by an appropriate separator membrane 144. The active principles can be released into the free space of the cannula 141 by rupturing said separator membrane 144, and this may be performed by tightening said end stopper 143 fully onto the dispenser orifice of the cannula 141. In a variant, the stopper may contain at least one active principle, and said cannula 141 may also contain at least one active principle. In this configuration, the active principles may also be mixed together in the cannula, in particular by tightening said end stopper fully. In the embodiment in FIG. 8, the reservoir 12 is filled with liquid, not via the neck of the reservoir closed by the blister 100, but via a filling opening 121 provided at the base of said reservoir, and thus remote from said neck. In this particular configuration, said reservoir is closed by a leaktight stopper 400 that may be secured to the grip tab 46, which leaktight stopper advantageously provides permanent sealing after said filling. It should immediately be understood that this embodiment provides a clear technical advantage, namely that of enabling the device to be fully assembled and the reservoir closure blister to be put into place in conditions of cleanliness and dryness that are easier. The reservoir may thus be filled at the very last stage, in automated manner, as soon as necessary, while the device as a whole is already ready. The techniques and the organization of the manufacturing and assembly sequences thus become extremely flexible, the reservoir being filled as soon as necessary on products that are already complete, thereby reducing the constraints of manufacturing delays.

Figure 8:
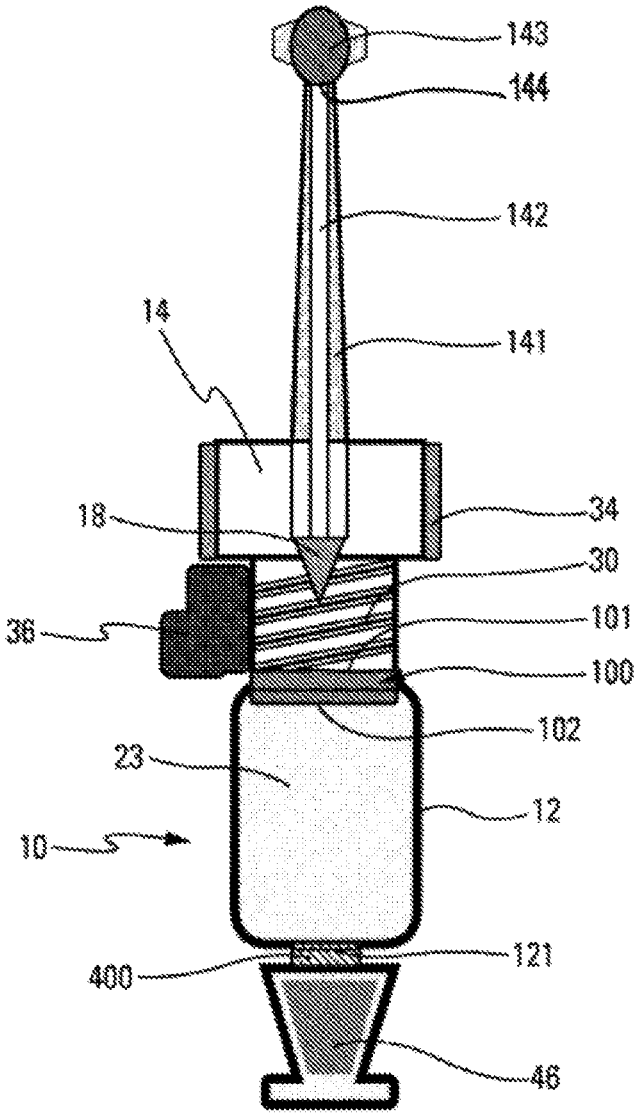
FIG. 8 is a diagrammatic section view of a second advantageous embodiment of the invention.

In still another advantageous aspect, both for the first embodiment of FIGS. 1 and 2 for injectable solutions and for the second embodiment of FIG. 8 for administration via the oral mucous membrane of active principles that have been put into a hydro-alcoholic solution, a sealing gasket 300 may be arranged inside the portion of the head 14 that receives the tapping 34, so as to guarantee leaktightness of the device after perforation, when tightening the head 14 brings it into abutment against the top edge of the neck of the reservoir 12. Compressing the gasket 300 between the two sections forming the head 14 and the reservoir 12 guarantees that complete and sufficient sealing is provided, given the short time before the substance is used once it has been made up.

Preferably, in a device of the first embodiment in FIGS. 1 and 2, namely a device of the type described in document WO 2009/138644 for injectable solutions, the device preferably contains a quantity of active principle and a volume of liquid that are slightly greater than the useful therapeutic doses, in order to avoid risking an under dose of the substance, whether it be associated with loss due to residual confinement inside the device, or with a manipulation error while taking the dose.

Various modifications are possible for the skilled person without departing from the scope of the present invention as defined in the accompanying claims. In particular, the various characteristics and functions of the device described in the various embodiments and variants can be combined together in any appropriate manner.

The invention claimed is:

1. A device for packaging, conserving, and extemporaneously preparing a plurality of active principles, said device comprising:

a reservoir having at least one compartment for containing at least one volume of liquid, said reservoir including a neck that defines a dispenser opening of the reservoir;

a head that is movable relative to said reservoir between a first position for conservation, in which said head is in a distal position relative to the reservoir, and a second position for preparation, in which said head is in a proximal position relative to the reservoir;

leaktight closure for closing the neck of said reservoir; and rupture means for rupturing said leaktight closure;

wherein said leaktight closure is formed by a leaktight blister that contains at least two active principles, said blister having at least two compartments that are separated by longitudinal and/or transverse and/or superposed partitions, each compartment containing an active principle, said blister being fastened on the neck of said reservoir so as to close said reservoir in leaktight manner, such that after opening said blister by said rupture means, said active principles enter into contact with the liquid and dissolve therein; and wherein said reservoir includes a filling opening that is remote from said neck of the reservoir, said filling opening being sealed in leaktight manner by a stopper after filling said reservoir with said liquid; and wherein said head includes a filter and a dose-taking membrane, an internal component being inserted into said head so as to define said dose-taking chamber in the volume defined in said internal component between said filter and said dose-taking membrane.

2. The device according to claim 1, wherein at least one active principle is in solid form.

3. The device according to claim 2, wherein at least one active principle is in the form of a powder, an ODT, a lyophilisate, a tablet, or a gel.

4. The device according to claim 1, wherein at least one active principle is in liquid form.

5. The device according to claim 1, wherein said blister includes an outer wall that faces towards the outside of the reservoir, and an inner wall that faces towards the inside of the reservoir.

6. The device according to claim 5, wherein said blister includes a radially-outer peripheral flange that is fastened on a radial edge of said reservoir.

7. The device according to claim 6, wherein said fastening is achieved by heat-sealing or high-frequency polymerization methods, or by leaktight crimping by mechanical stress with flexible gaskets under a formed or heat-shrink or crimped ring.

8. The device according to claim 1, wherein said blister is manufactured beforehand, filled with said active principles and sealed, before being fastened in leaktight manner on said reservoir.

9. The device according to claim 1, wherein a sealing gasket is interposed between the head and the reservoir so as to guarantee sealing after the blister has been opened by the rupture means.

10. The device according to claim 1, wherein said liquid contained in the reservoir is a solvent or a hydro-alcoholic solution.

11. The device according to claim 1, wherein the volume of said liquid contained in the reservoir is less than 5 mL.

12. The device according to claim 1, wherein the dimensions of said internal component can be varied, so as to define dose-taking chambers of shapes and volumes that vary.

13. The device according to claim 1, wherein said stopper is secured to a grip tab.

14. A device for packaging, conserving, and extemporaneously preparing a plurality of active principles, said device comprising:

a reservoir having at least one compartment for containing at least one volume of liquid, said reservoir including a neck that defines a dispenser opening of the reservoir;

a head that is movable relative to said reservoir between a first position for conservation, in which said head is in a distal position relative to the reservoir, and a second position for preparation, in which said head is in a proximal position relative to the reservoir;

leaktight closure for closing the neck of said reservoir; and rupture means for rupturing said leaktight closure;

wherein said leaktight closure is formed by a leaktight blister that contains at least two active principles, said blister having at least two compartments that are separated by at least one of a longitudinal or transverse or superposed partitions, each compartment containing an active principle, said blister being fastened on the neck of said reservoir so as to close said reservoir in leaktight manner, such that after opening said blister by said rupture means, said active principles enter into contact with the liquid and dissolve therein; and wherein said reservoir includes a filling opening that is remote from said neck of the reservoir, said filling opening being sealed in leaktight manner by a stopper after filling said reservoir with said liquid; and wherein said movable head includes a cannula having a dispenser orifice that is closed by an end stopper that contains at least one solid or liquid active principle that is held in said end stopper by a separator membrane, said cannula also containing at least one solid or liquid active principle, said active principles being mixed in said cannula by rupturing said separator membrane, advantageously by tightening said end stopper fully onto said dispenser orifice of said cannula.

15. A device for packaging, conserving, and extemporaneously preparing a plurality of active principles, said device comprising:

a reservoir having at least one compartment for containing at least one volume of liquid, said reservoir including a neck that defines a dispenser opening of the reservoir;

a head that is movable relative to said reservoir between a first position for conservation, in which said head is in its distal position relative to the reservoir, and a second position for preparation, in which said head is in its proximal position relative to the reservoir;

leaktight closure for closing the neck of said reservoir; and rupture means for rupturing said leaktight closure;

wherein said leaktight closure are formed by a leaktight blister that contains at least two active principles, said blister having at least two compartments that are separated by longitudinal and/or transverse and/or superposed partitions, each compartment containing an active principle, said blister being fastened on the neck of said reservoir so as to close said reservoir in leaktight manner, such that after opening said blister by said rupture means, said active principles enter into contact with the liquid and dissolve therein; and wherein said movable head includes a cannula having a dispenser orifice that is closed by an end stopper that contains solid or liquid active principles that are held in said end stopper by a separator membrane, said active principles being released into said cannula by rupturing said separator membrane.

16. The device according to claim 15, wherein said active principles is released into said cannula by rupturing said separator membrane by tightening said end stopper fully onto said dispenser orifice of said cannula.

* * * * *